US006553728B1

(12) United States Patent
Zurn

(10) Patent No.: US 6,553,728 B1
(45) Date of Patent: Apr. 29, 2003

(54) INSULATING GLASS UNIT PRESSURE EQUALIZATION VALVE

(75) Inventor: Benjamin James Zurn, Roseville, MN (US)

(73) Assignee: Cardinal IG Company, Minnetonka, MN (US)

( * ) Notice: Subject to any disclaimer, the term of this patent is extended or adjusted under 35 U.S.C. 154(b) by 0 days.

(21) Appl. No.: 09/716,503

(22) Filed: Nov. 20, 2000

(51) Int. Cl.[7] ..... E06B 7/12

(52) U.S. Cl. ..... 52/171.3; 52/302.7; 52/171; 52/172; 52/204.52; 251/215; 251/216

(58) Field of Search ..... 52/204.52, 171.3, 52/209; 251/215, 216, 339; 220/303

(56) References Cited

U.S. PATENT DOCUMENTS

| | | | | |
|---|---|---|---|---|
| 2,125,372 A | * | 8/1938 | Fox | 20/56.5 |
| 2,302,740 A | * | 11/1942 | Boicey | 20/56.5 |
| 2,621,397 A | | 12/1952 | Black | |
| 2,755,521 A | | 7/1956 | Lippman, Jr. | |
| 2,756,467 A | | 7/1956 | Etling | |
| 2,784,462 A | | 3/1957 | Fix | |
| 2,795,018 A | | 6/1957 | Shaw | |
| 2,805,452 A | | 9/1957 | Englehart | |
| 2,880,475 A | | 4/1959 | Mills | |
| 2,886,864 A | | 5/1959 | Boicey et al. | |
| 2,887,737 A | | 5/1959 | Prescott | |
| 2,887,738 A | | 5/1959 | Prescott et al. | |
| 2,894,294 A | | 7/1959 | Prescott | |
| 3,027,607 A | | 4/1962 | Badger et al. | |
| 3,812,757 A | | 5/1974 | Reiland | |
| 3,844,437 A | | 10/1974 | O'Connor | |
| 4,026,512 A | * | 5/1977 | Holt | 249/141 |
| 4,174,424 A | | 11/1979 | Jurva et al. | |
| 4,567,703 A | * | 2/1986 | Ricks | 52/304 |
| 4,587,784 A | * | 5/1986 | Chavy et al. | 52/304 |
| H975 H | * | 11/1991 | Selkowitz | 52/172 |
| 5,345,734 A | | 9/1994 | Tremblay | |
| 5,368,181 A | * | 11/1994 | Myers | 220/303 |

FOREIGN PATENT DOCUMENTS

| | | |
|---|---|---|
| FR | 2 344 700 A | 10/1997 |
| GB | 2 275 047 A | 8/1994 |
| WO | WO 95 26895 A | 10/1995 |

* cited by examiner

*Primary Examiner*—Carl D. Friedman
*Assistant Examiner*—Basil Katcheves
(74) *Attorney, Agent, or Firm*—Fredrikson & Byron, PA

(57) ABSTRACT

A pressure equalization valve enabling equalization of pressure between the between-pane space of an insulating glass unit and ambient pressure, and glass units containing such a valve. The pressure equalization valve generally includes a valve body having a cavity therein and opposed, open ends and an elongated valve plug received in said valve body and securably shiftable along its length between plugged and unplugged configurations. The valve may be secured about an aperture in a glass pane. The valve body has a shoulder at one end, and the pane thickness is sandwiched between the shoulder and a washer preferably press-fitted to the other end of the body. The valve body cavity and the valve plug may include engaging threaded portions enabling the valve plug by rotation thereof to be shifted axially of the valve body between plugged and unplugged positions, the valve body and valve plug having engagable portions securing the plug against accidental escape from the body by axial, non-rotating movement of the plug.

33 Claims, 4 Drawing Sheets

INSULATING GLASS UNIT PRESSURE EQUALIZATION VALVE

BACKGROUND OF THE INVENTION

1. Field of the Invention

The present invention relates to valves for equalizing pressure between two spaces of unequal pressure, and more particularly to a valve for equalizing the pressure between the enclosed space of an insulating glass unit and the ambient atmosphere.

2. Background of the Invention

Insulating glass units ("IG units") have long been used in the building trades and other applications. Insulating glass units generally comprise at least two glass panes held in a generally parallel, spaced orientation by a peripheral spacer, the latter being joined to the sheets by a sealant. The space defined between the glass panes is hermetically sealed. High performance insulating glass is often manufactured using various technologies to improve energy efficiency, optical clarity and resistance to deterioration. The technology involving insulating glass units filled with a gas such as argon having a low coefficient of thermal conductivity is of particular interest.

Problems have been encountered with IG units carrying a gas such as argon in their between-pane spaces. Over a period of time, argon may slowly leak from the between-pane space to the atmosphere, and this generally occurs at a rate greater than the rate of permeation of air into the space, with the result that the pressure in the between-pane space reduced below atmospheric pressure. The resulting pressure differential causes the panes to cup inwardly, and the panes can eventually touch near their centers, with consequent loss of insulating value. In some cases, the cupping of the panes is so great as to cause one or the other of the panes to shatter. When failure occurs, the window units necessarily have to be replaced, and this can be extremely expensive in that the failed window unit must be removed and replaced with a new unit on a unit-by-unit basis.

Moreover, when IG units are transported to geographic locations of higher elevation and hence reduced atmospheric pressure, the panes of these IG units may bulge outwardly under the pressure differential across the panes, and this also causes distortion of the panes and may lead to ultimate glass breakage.

One possible remedy to this problem is to insert a valve in the insulating glass unit. A variety of valves or valve-like structures have been suggested to allow communication between the interior of insulating glass units and the ambient atmosphere. U.S. Pat. No. 4,567,703 (Ricks) discloses a spring-biased reusable valve intended to be opened over and over again whenever desired to equalize pressure between the interior of the insulating glass unit and the ambient atmosphere. U.S. Pat. No. 2,880,475 (Mills) discloses a self-sealing rubber valve. The Mills valve is designed to enable evacuation of the space between the panes of an insulating glass unit. The valve is configured similar to a duck bill valve, which accommodates the insertion of an exterior tube for release of interior pressure. U.S. Pat. No. 5,345,734 (Tremblay) discloses a plug to be inserted in the spacer at the periphery of an insulating glass unit. Once in place, the Tremblay plug is permanently sealed by the use of a plug similar in structure to a blind rivet.

Other examples of valve-like devices used in concert with insulating glass units are not truly valves at all in that they are designed to be sealed once and cannot be opened again under normal circumstances. Examples include U.S. Pat. No. 3,027,607 (Badger et al.), which discloses a metal insert to be embedded in the peripheral seal of the insulating glass unit to provide for gas injection and then to be permanently sealed with a bead of solder.

Additionally, U.S. Pat. No. 4,587,784 issued to Chavy et al discloses a structure similar to that of Badger that is intended to melt and release pressure within the IGU in the case of a structural fire. Under the heat of a fire, a fusible plug melts. Releasing increased pressure restrains the insulating glass unit from breaking.

U.S. Pat. No. 2,756,467 (Etling) shows the use of a hypodermic. needle passed through a sealant which forms a "self healing" seal when the needle is withdrawn. The Etling approach is intended to be used to evacuate the space within an insulating glass unit.

Finally, a number of prior art patents relate to the creation and sealing of pore holes which are intended to prevent the breakage of some types of insulating glass units in the manufacturing process. If an insulating glass unit is manufactured entirely of glass and the edges of the two panes are fused at their periphery, during the process of cooling the gases entrapped between the two panes contract dramatically creating a substantial possibility of breakage. Examples of a variety of pore holes and methods of sealing them are discussed in U.S. Pat. Nos. 2,784,462, 2,805,452, 2,887,737, 2,887,738, 2,894,294, 2,621,397, 2,886,864 and 2,755,521.

It would be desirable to be able manufacture an insulating glass unit, optionally containing an inert gas, such as argon, ship it to another location for further fabrication, storage or installation, and then have the capability to equalize the pressure in the insulating glass unit with the ambient atmosphere by either venting gas from the unit or allowing a gas such as air to enter the space between the panes. Furthermore, it would be desirable to be able to perform this function at anytime over the life of the insulating glass unit without undesired leakage occurring. Once pressure equalization is accomplished, it would be desirable to reseal the unit so as to prevent leakage of the entrapped gas.

SUMMARY OF THE INVENTION

The present invention relates to a pressure equalization valve utilized to equalize the pressure inside an insulating glass unit with the outside atmosphere. The pressure equalization valve of the present invention may be applied to one of the panes of an insulating glass unit so that the pressure within the between-pane space of the insulating glass unit may be equalized with the exterior, ambient pressure as and when needed.

The pressure equalization valve generally comprises a valve body having a stem for passing through an aperture in a glass pane, the body having an internal cavity and opposed, open ends to allow a gas to flow through it and also having an enlarged shoulder at one end for sealing engagement with a glass pane about the periphery of the aperture. The valve includes a valve plug that is received in the cavity and that is securably shiftable axially along its length between a plugged position preventing gas flow through the valve body and an unplugged position enabling such gas flow. "Securably shiftable" means that the valve plug is prevented from accidentally escaping axially from the valve body when the plug is in its unplugged position. This feature is valuable in that it prevents the plug from being unintentionally removed or lost.

In a preferred embodiment, the internal cavity includes an internally threaded portion, and the valve plug includes an externally threaded portion that threadingly engages the internally threaded bore when the valve is in its plugged position. The plug further contains a second portion of lesser diameter but of greater axial length than the internally threaded bore of the valve body. Further, the valve plug preferably includes a third portion of a diameter preventing it from passing axially without rotation through the internally threaded bore. The lesser diameter second portion is intermediate the threaded first portion and the third portion such that when the first portion is unscrewed from the threaded bore, the space between the lesser diameter second, portion and the threaded bore provides a passageway for gas flow through the valve. Preferably, the third portion of the valve plug has exterior threads enabling it to be threadingly received in the threaded bore, thereby permitting the valve plug to be entirely unscrewed from the valve body.

The valve further preferably includes a washer assembly into which the end of the stem remote from its shoulder is received, the dimensions of the stem and the washer providing desirably for a secure press fit of the washer onto the system.

In the manufacturing process, an aperture is drilled through a glass pane, and the valve stem is inserted through the aperture from one side of the pane to bring the shoulder of the valve body into sealing engagement with the pane surface. The washer is received over the end of the stem on the other side of the pane and is secured to the stem, preferably through a press fit, thus sandwiching the glass pane securely between the shoulder and the washer. The valve plug may be part of the assembly thus secured to the glass pane, or it may be added after the plug body has been thus secured. Generally this placement of the valve will be accomplished before the panes are assembled into an insulating glass unit. The pane, with valve secured and preferably in its plugged position, is then employed in the assembly of an IG unit, the assembly commonly taking place in an atmosphere of e.g., argon to provide the unit with an argon filled between-pane space.

Once the insulating glass unit has been shipped to a desired location for installation the valve may be opened to allow the unit to "breath", thus equalizing the pressure across the panes. Once this occurs, the threaded plug may be tightened to seal the insulating glass unit. If desired, the threaded plug may then be disabled to prevent tampering which would cause loss or contamination of the retained gas. Optionally, a cap may be placed over the shouldered portion of the valve body to further protect the valve from tampering by unauthorized persons. The cap may, optionally, be decorative in design.

DETAILED DESCRIPTION OF THE INVENTION

Figure 2:
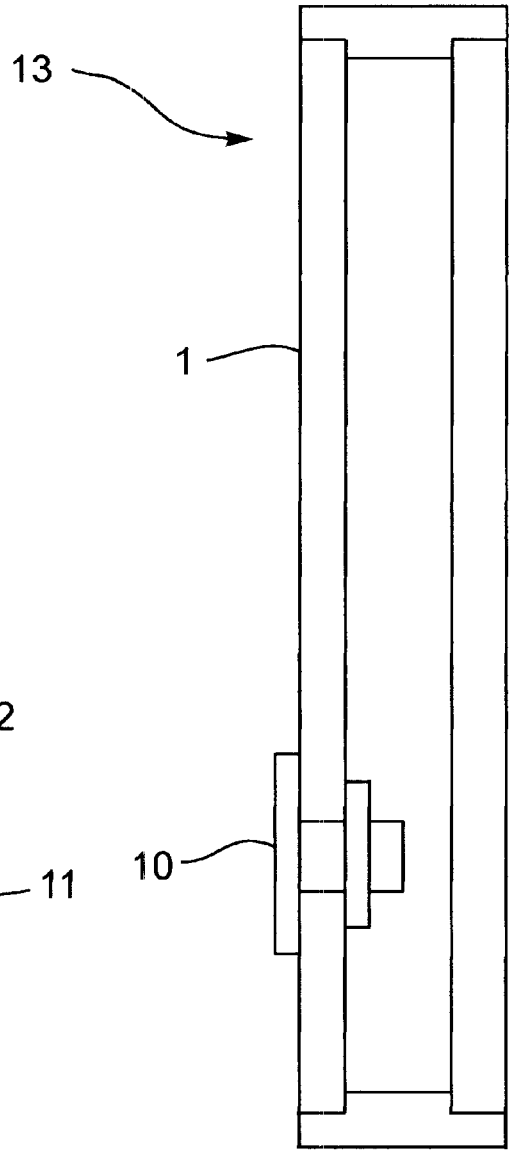
FIG. 2 is a side plan view of an embodiment of a pressure equalization valve applied to a insulating glass unit in accordance with the present invention, the valve being shown in outline only to indicate its location with respect to the IG unit.
Figure 1:
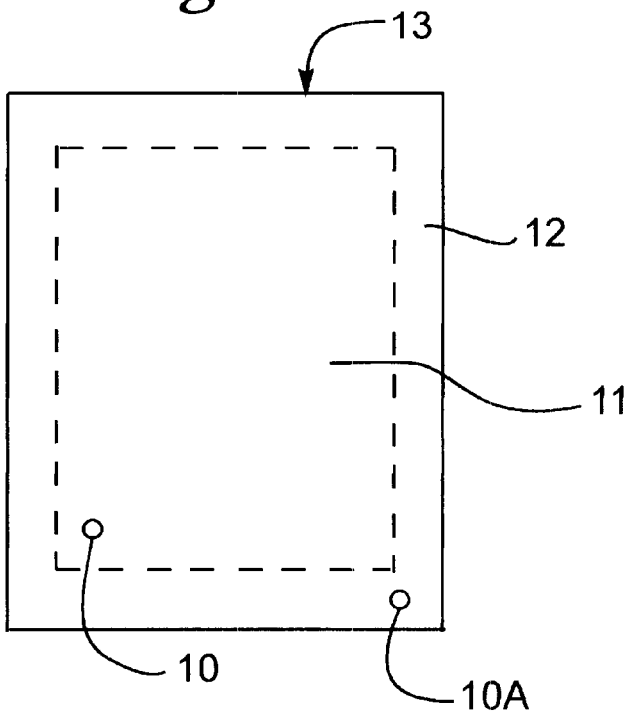
FIG. 1 is a front plan view of an embodiment of a pressure equalization valve administered to a pane of glass in accordance with the present invention.

FIGS. 1–5 depict an embodiment of a pressure equalization valve 10 secured to a glass pane 11 within an optional frame 12 of an insulating glass unit 13. Embodiments of a pressure equalization valve generally include a valve body 14, a washer 16, a valve plug 18, and optionally, a cap 20. As shown in FIG. 1, the valve 10 may be provided in a corner of an IG unit, just within the sight line, or may be placed beneath subsequently added trim or framing, such location being designated 10A in FIG. 1.

Figure 3:
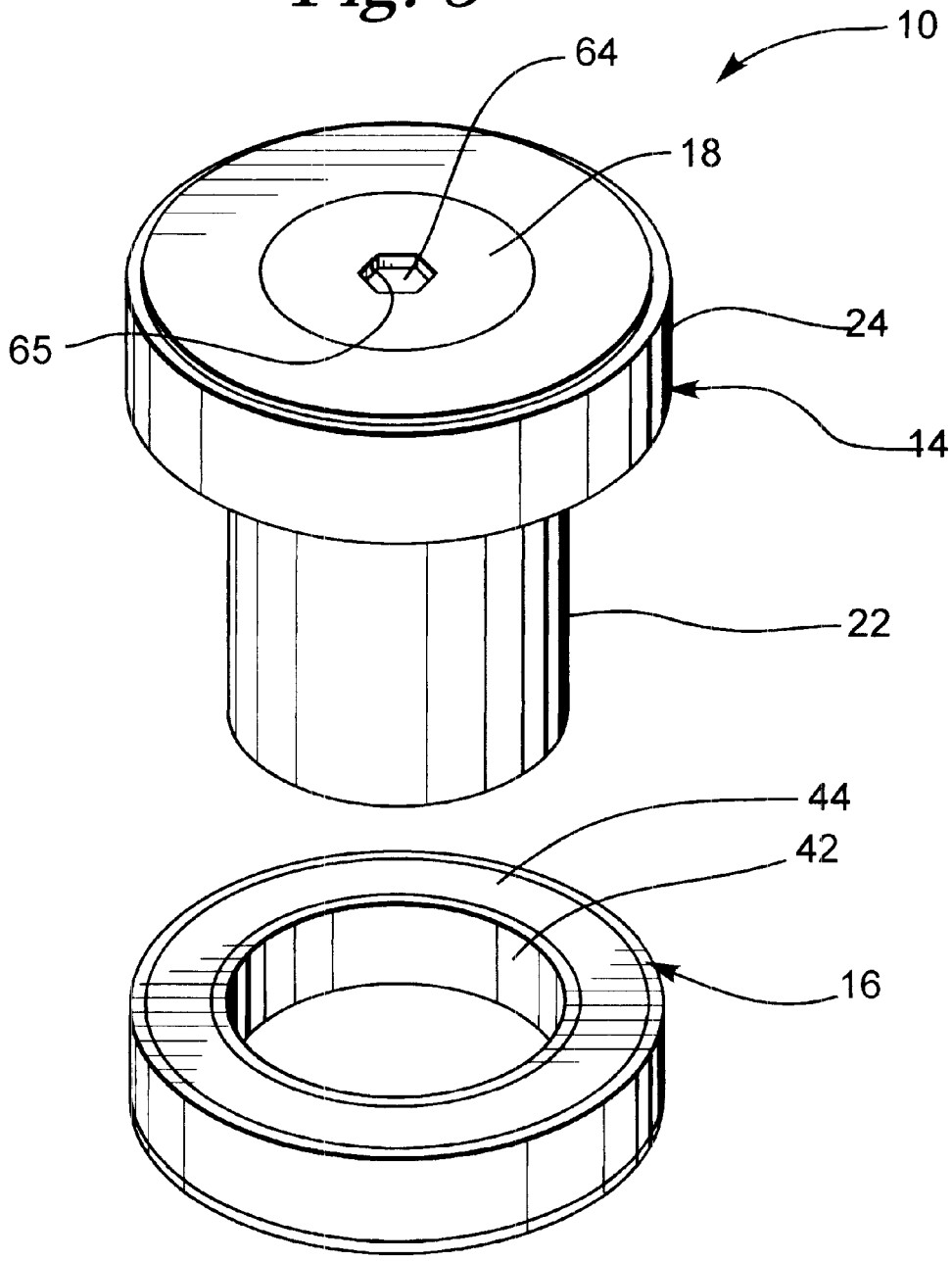
FIG. 3 is perspective, exploded view of an embodiment of a pressure equalization valve of the present invention.
Figure 4:
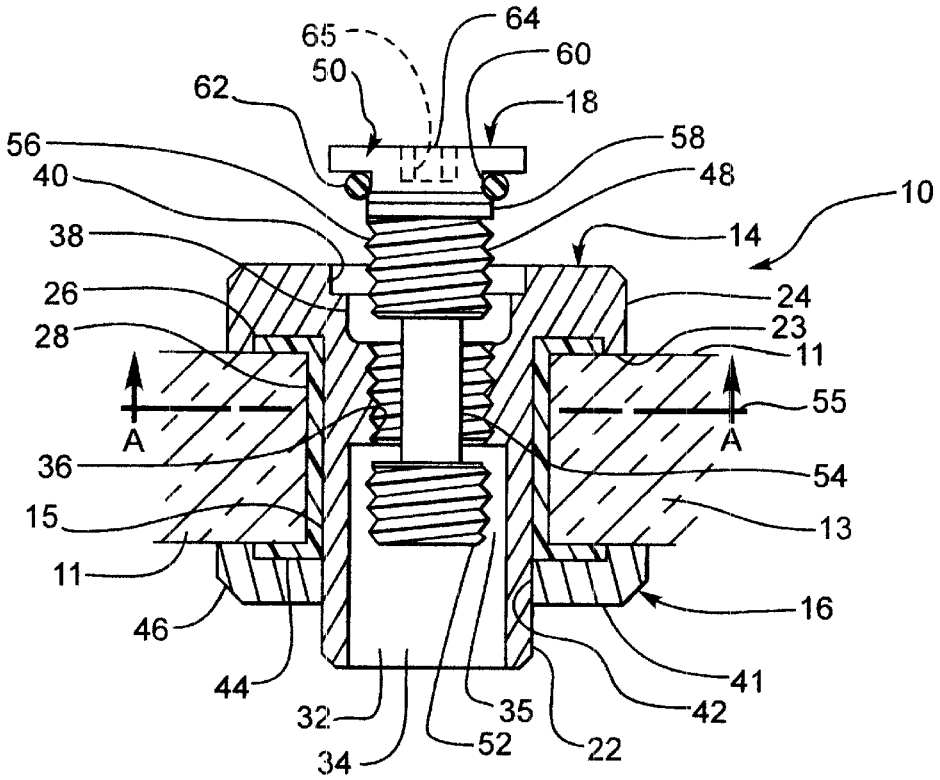
FIG. 4 is a cross-sectional view of an embodiment of the pressure equalization valve of FIG. 3, in an open or unplugged configuration.
Figure 5:
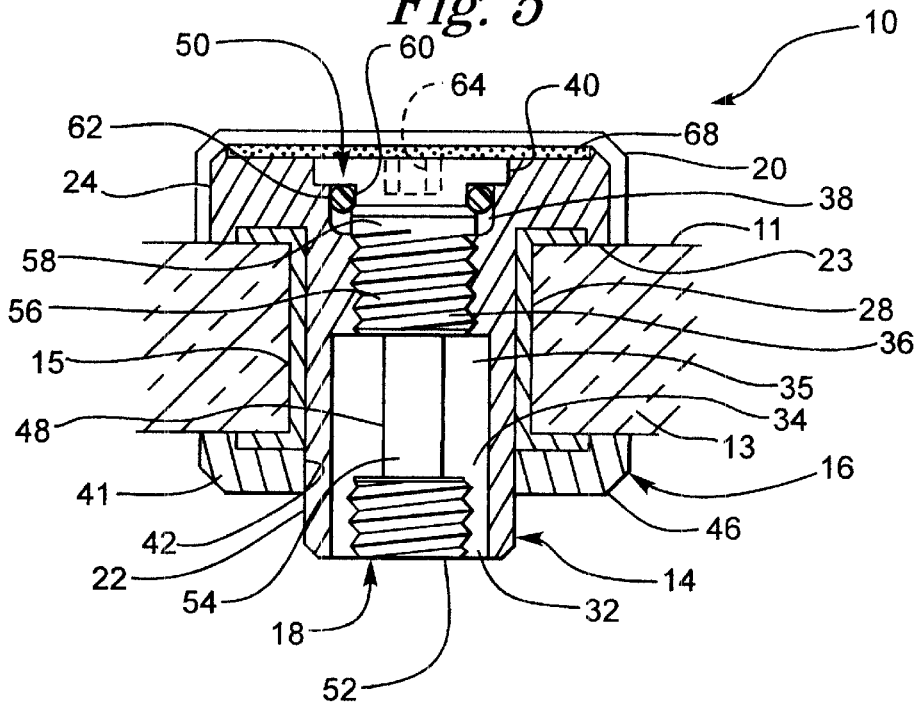
FIG. 5 is a cross-sectional view of an embodiment of the pressure equalization valve of FIG. 3 in a closed or plugged configuration.

As depicted in FIGS. 3–5, the valve body 14 includes a generally cylindrical stem 22 having a shoulder 24 at one end. However, the shape of the stem may be of any shape which would provide similar functions. The shoulder 24 is adjoined with the stem 22 and includes an annular surface 23 which faces and confronts the surface of the glass pane 11 about the periphery of the aperture 15 extending through it. The stem and shoulder preferably are integrally formed by machining. The annular surface optionally includes an annular recess 26 which may receive sealant 28.

In the embodiment depicted in FIGS. 3–5, the valve body includes an internal cavity 34 including a bore 32 extending longitudinally therethrough. Referring to FIGS. 4 and 5, the cavity 34 includes an internally threaded chamber 36 having a plug seat 38 at one end thereof and an inner chamber 35 at its other end. An optional enlarged bore entry 40 is also shown. Preferably, the internally threaded chamber 36 is smaller in diameter than the inner chamber 35 and the plug seat 38. Bore entry 40 is normally larger in diameter than plug seat 38.

The pressure equalization valve of the present invention also includes a washer assembly 16 comprising a washer and optional sealant for the purpose of securing the valve to a glass pane. The washer assembly includes a washer 41 bearing an aperture 42 that is sized to receive stem 22 therethrough. The washer assembly 16 may further include a flat face (not shown) or an annular recess 44 on one face, with an optional bevel 46 on its opposite face. The flat face or recess 44 may be adapted to accommodate the application of a sealant for adjoining and sealing the valve body 14 and glass pane 11 with the washer assembly 16.

FIGS. 4 and 5 additionally illustrate an elongated valve plug 18 having a shaft 48 and head 50. The shaft 48 includes a first threaded portion 56 adjacent the head 50, an second threaded portion 52, and an intermediate unthreaded portion 54, the intermediate portion being longer than the axial length of the internally threaded chamber 36 and also of smaller diameter so as to establish a pathway for air or other gas to pass through the valve body when the plug is in the unplugged position shown in FIG. 4. Head 50 includes a collar 58, a sealing seat 60 onto which a sealing device 62 such as an O-ring may be received, and an exteriorly accessible tool-engaging element such as socket 64. Socket 64 includes tool-engaging surfaces 65 adapted to receive any turning tool, such as an Allen wrench or a Phillips or flat head screwdriver. The tool engaging element may be of any appropriate type, such as a square or hexagonal head shaped to receive a wrench, etc.

Tool engaging surfaces 65 are preferably not frangible under high torque. However, in one embodiment, soft or otherwise readily deformed surface materials may be incorporated into the socket, these materials being readily distorted by application of high torque so as not to again be suitably engagable with the tools to rotate the valve plug, thus prevent reopening of the valve. The use of deformable surfaces in the socket 64 (as by incorporating a soft metal such as copper in the socket) would reduce undesired tampering with the pressure equalization valve 10 and thereby prevent unwanted opening of the valve. For example, the walls of an Allen wrench socket may be formed of a soft metal such that the application of substantial torque to the socket causes the surfaces to deform and become rounded.

When the valve plug has been threaded entirely into the valve body, as shown in FIG. 5, the head 50 of the plug is received in the bore entry 40 and the O-ring 62 seats in the plug seat 38 to provide a gas-tight seal. In this "plugged" position, the first threaded portion 56 of the valve plug is threadingly received in the threaded chamber 36. When it is desired to open the valve, the valve plug is threaded out of the threaded chamber 36 into the position shown in FIG. 4, thereby opening a pathway for the flow of a gas through the valve body. However, inasmuch as the second threaded portion 52 of the valve plug is dimensioned to be threadingly received in the threaded chamber 36, the valve plug cannot accidentally escape outwardly of the valve body. If it is desired to remove the valve plug entirely from the valve body, the inner threaded portion 52 may simply be unscrewed from the threaded chamber 36.

The dimensions of the second threaded portion 52 and the threaded chamber 36 thus cooperate to enable the valve plug to be securably shiftable as it moves axially within the valve body, that is, in a manner preventing accidental escape of the valve plug from the valve body when the valve is in its unplugged position.

Figure 6:
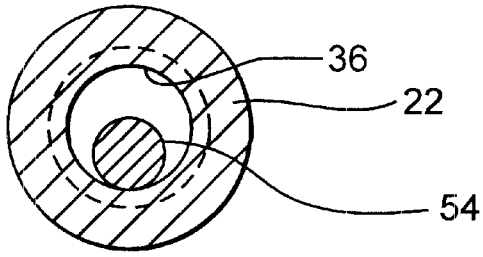
FIG. 6 is a sectional view taken along line A—A of FIG. 2.
Figure 7:
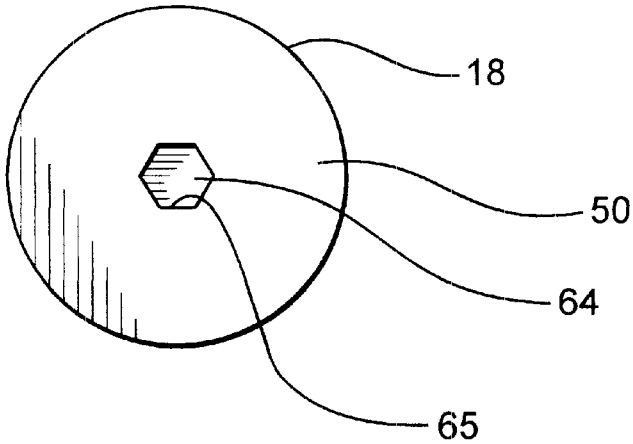
FIG. 7 is a plan view of an embodiment of the head of a threaded plug as used in accordance with the present invention.

FIG. 6 depicts a top view of an embodiment of the pressure equalization valve 10, wherein the head 50 is omitted to illustrate the relationship of the unthreaded stem 54 and the thread receiving chamber. Moreover, FIG. 6 is a top view of the lower half of an embodiment of the pressure equalization valve including the features below dividing line 55 of FIG. 4.

Figure 8:
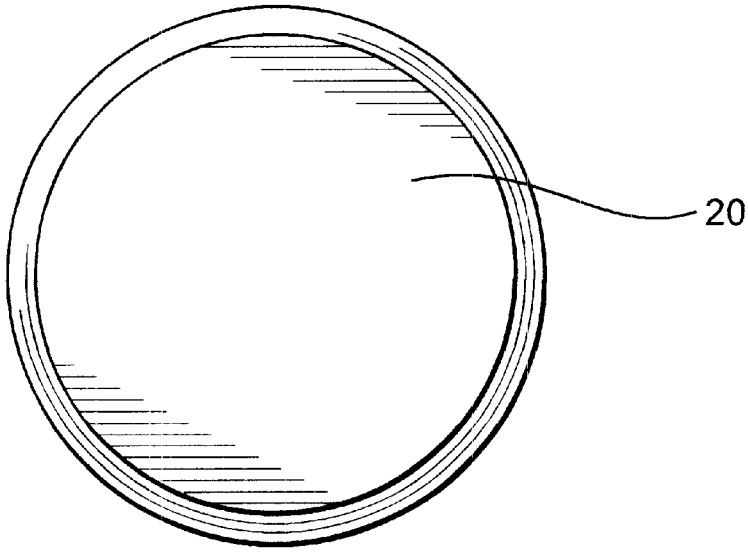
FIG. 8 is a plan view of an embodiment of a cap in accordance with the present invention.

Referring to FIGS. 5 and 8, optional cap 20 is sized so as to be received over shoulder 24 of valve 10. Cap 20 may snap-fit over shoulder 24 of valve 10, or may be held in place by a pressure-sensitive adhesive 68, or by any other appropriate techniques. Cap 20 may optionally include a decorative design. The cap 20 may also be adapted to provide an additional sealing mechanism for the prevention of undesired leakage. The addition of sealing devices, such as an O-ring, may be included in the cap 20 if desired.

Pressure equalization valve 10 is preferably manufactured of a corrosion resistant metal such as brass or another suitable metal or alloy. However, it may be manufactured of any other material of appropriate strength, rigidity and corrosion resistance such as aluminum or an appropriate polymer.

If desired, the sealant 28 may be applied to the outer surfaces of the stem 22 and onto the facing surfaces of the shoulder and washer between which the glass pane is sandwiched. Sealant 28 desirably is a soft, formable polymer composition such as 40 polyisobutylene, and preferably is substantially impermeable to the selected gas filling.

In operation, referring to FIGS. 4 and 5, an appropriately sized hole is made in glass pane 12. Valve body 14 is inserted into glass pane 12, and as noted above, sealant may be applied to the valve body as illustrated. An annular ring of a formable sealant may be placed around the valve body and against the annular recess 26 so that as the shoulder 24 is pressed against the glass pane 11, the sealant conforms to the confronting surfaces of the pane and the shoulder to form a gas-tight seal. Shoulder 24 is pressed snugly against the glass pane 12.

The washer assembly 16 is applied over stem 22 against the other side of the glass pane with an appropriate pressing tool, e.g., a pliers with jaws appropriately shaped to contact the shoulder 28 of the valve body and the outer surface of the washer 41 until the washer is snugly positioned against glass pane 12. Other pressing mechanisms, e.g., using pneumatic or hydraulic driven jaws to apply a predetermined appropriate force to the washer to secure it to the stem 22, will be evident to the skilled artisan. If desired, the stem 22 and interior of the washer assembly 16 may be threaded in order to secure the washer assembly 16 to stem 22, or, if desired, crimping may be employed to secure the washer to the stem or a separate threaded nut may be threaded onto a threaded end of the stem to urge the washer against glass surface. In the preferred embodiment, however, the washer assembly and the stem are so closely dimensioned as to permit the washer to be press-fitted over the stem 22. Note that an annular ring of a formable sealant may be placed around the aperture of the washer and against the annular recess 44 so that as the washer is pressed against the confronting surface of the glass pane, the sealant conforms to the surfaces of the washer and glass, providing a gas-tight seal.

Another possible alternative is that pressure equalization valve 10 may also be located in the peripheral seal of an insulating glass unit if desired. The process as described above would be performed to place the pressure equalization valve 10 in the peripheral seal instead of the glass pane. It is further noted that the pressure equalization valve 10 may be concealed under a window frame or trim application as depicted in FIG. 1.

Valves of the invention may be installed in glass sheets, preferably near the corners of the sheets (that is, preferably near the sight line of the panes after the IG unit has been appropriately framed), before the sheets are assembled into IG units. The valves desirably are installed in their closed or plugged positions, with a gas such as argon being included in the between-pane space during fabrication of the glass panes into IG units using known methods and apparatuses, one of which is shown in U.S. Pat. No. 4,909,874 (Rueckheim). Here, the glass panes and peripheral spacer are assembled while in an argon or other gas atmosphere. The completed IG unit commonly is shipped to another location at which it is provided with appropriate framing.

Once the manufacturing process is complete the insulating glass unit 13 may be shipped to the location of intended installation. At any time when it is desired to equalize the pressure differential across the glass panes, the valve plug may be unscrewed sufficiently to enable gas to flow through the valve until the pressure in the between-pane space is equal to ambient pressure. This step may be performed whenever needed. Although it may most often be used to relieve pressure differences encountered between the geographic location of assembly of the IG unit and the location where it is to be installed, it may be appropriate to equalize pressures at some other location. For example, an IG unit may be manufactured at a location near sea level, and then transported to an altitude of, say, 5000 feet (about 1500 meters) for ultimate installation in a building at an altitude of 8000 feet (about 2400 meters). Here, it may be convenient to equalize pressures at the 5000 feet location rather than the 8000 feet location.

The above description has referred primarily to enabling an IG unit to "breath" when the valve is opened in order to achieve pressure equalization, the valve "exhaling" argon or other gas when the pressure between the panes is greater than ambient pressure and "inhaling" air when the internal pressure is less than ambient pressure. It should be understood that the valve may, if desired, be connected to a source of a gas such as argon so that when the unit "inhales" as the valve is opened, it receives gas from that source. It may be desirable in some circumstances to purge the between-pane space by continuing to supply argon or other gas through the valve into the between pane space while concurrently permitting gas from within that space to escape outwardly through the valve. This may be accomplished, for example, by passing the gas under pressure through a flexible tube that extends at least partially through the valve.

While the invention has been described in conjunction with specific embodiments thereof, it is evident that many alternatives, modifications, and variations will be apparent to those skilled in the art in light of the foregoing description. Accordingly, it is intended to embrace all such alternatives, modifications, and variations which fall within the spirit and broad scope of the invention.

What is claimed is:

1. A pressure equalization valve mountable to a glass pane of an insulating glass unit for equalizing the pressure between the inside of the insulating glass unit and an ambient atmosphere comprising:

a valve body including a stem, an internal cavity and opposed open ends;

a washer assembly comprising a washer including an inner face adapted to snugly position against said glass pane and an aperture sized to receive said stem therethrough; and an elongated valve plug received in said internal cavity of said valve body and securably shiftable axially along its length between plugged and unplugged positions.

2. The pressure equalization valve of claim 1 wherein said internal cavity and valve plug include engaging threaded portions enabling said valve plug by rotation thereof to be shifted axially of said valve body between plugged and unplugged positions, said valve body and valve plug having engagable portions securing said plug against accidental escape from said body by axial, non-rotating movement of said plug.

3. The pressure equalization valve of claim 1 wherein said internal cavity includes a threaded bore and wherein said valve plug includes a first threaded portion threadingly engaging the threaded bore and enabling said valve plug by rotation thereof to be shifted axially of said valve body between plugged and unplugged positions, said valve plug including a second portion dimensioned to prevent it from escaping through said threaded bore in the absence of rotation of the plug to thereby secure said plug against accidental escape from said valve body.

4. The pressure equalization valve of claim 3 wherein said valve plug includes a portion intermediate said first and second portions and dimensioned so as to form a gas passageway between it and the threaded bore when said first threaded portion is unscrewed from said threaded bore.

5. The pressure equalization valve of claim 4 wherein said second valve plug portion is threaded to be threadingly received in said threaded bore to enable said plug to be completely unscrewed from said valve body.

6. The pressure equalization valve of claim 1, wherein said valve body includes a shoulder at one end providing an annular surface sealable to the glass pane.

7. The pressure equalization valve of claim 6 wherein said washer is dimensioned so as to be securely press-fitted over said stem wherein said glass pane is snugly positioned between said annular surface of said valve body and said inner face of said washer.

8. The pressure equalization valve of claim 1 said valve plug includes an outwardly accessible tool-engaging portion enabling the valve plug to be rotated with respect to said valve body to shift said plug between plugged and unplugged positions.

9. The pressure equalization valve of claim 8 wherein said tool engaging portion includes a portion that can be readily deformed upon application of torque to prevent said tool engaging portion from being reused.

10. The pressure equalization valve of claim 9 wherein said tool engaging portion comprises a socket having deformable, too-engaging sides.

11. The pressure equalization valve of claim 1 wherein said washer assembly further comprises an annular recess on said inner face and a bevel on its opposing face.

12. The pressure equalization valve of claim 11 wherein said valve body and washer assembly further comprises a sealant.

13. The pressure equalization valve of claim 1 wherein said stem and interior of said washer are threaded.

14. The pressure equalization valve of claim 1 wherein said stem and elongated valve plug are dimensioned to fit inside a between-pane space of an insulating glass unit.

15. The pressure equalization valve of claim 1 wherein said valve body includes a plug seat and said valve plug includes an O-ring that seats in said plug seat to provide a gas-tight seal.

16. A pressure equalization valve mountable to a glass pane of an insulating glass unit about an aperture formed in the pane for equalizing the pressure between the inside of the insulating glass unit and an ambient temperature atmosphere, comprising:

a valve body having a stem, a cavity therein and opposed, open ends, said cavity including an internally threaded bore;

a washer assembly comprising a washer including an inner face adapted to snugly position against said glass pane and wherein said washer is dimensioned so as to be securely press-fitted over said stem that passes therethrough; and an elongated valve plug received in said valve body and securably shiftable along its length between plugged and unplugged configurations, said valve plug having a shaft, said shaft including a first threaded portion threadingly engaging the internally threaded bore and enabling said valve plug by rotation thereof to be shifted axially of said valve body between plugged and unplugged positions, a second portion dimensioned to prevent said plug from escaping through said threaded bore in the absence of rotation of the plug to thereby secure said plug against accidental escape from said valve body, and a third portion intermediate said first and second portions and dimensioned so as to form a gas passageway whereby gas flows between said third portion of said shaft and the internally threaded bore when said first threaded portion is unscrewed from said internally threaded bore.

17. The pressure equalization valve of claim 16, wherein said valve body includes a shoulder at one end providing an annular surface sealable to the glass pane about the aperture therein, and said washer further comprises an annular surface contiguous to the glass pane whereby the glass pane is snugly postitioned between said annular surfaces of said shoulder and washer.

18. A pressure equalization valve mountable to a glass pane of an insulating glass unit about an aperture formed in the pane for equalizing the pressure between the inside of the insulating glass unit and an ambient atmosphere, comprising:

a valve body having a cavity therein and opposed, open ends, said body having a shoulder at one end to engage one side of the pane about its aperture;

an elongated valve plug received in said valve body and securably shiftable along its length between plugged and unplugged configurations; and a washer receivable over and securable to the other end of said valve body to engage the other side of the pane about its aperture to thereby sandwich the pane between said shoulder and washer.

19. The pressure equalization valve of claim 18 wherein said washer is so dimensioned with respect to said other end of said valve body as to be securely press-fitted thereover.

20. The pressure equalization valve of claim 18 or claim 16 wherein said valve plug includes an outwardly accessible tool-engaging portion enabling the valve plug to be rotated with respect to said valve body to shift said plug between plugged and unplugged positions.

21. The pressure equalization valve of claim 20 herein said tool engaging portion includes a portion that can be readily deformed upon application of torque to prevent said tool engaging portion from being reused.

22. The pressure equalization valve of claim 20 wherein said cavity includes an internally threaded bore and wherein said valve plug includes a first threaded portion threadingly engaging the internally threaded bore and enabling said valve plug by rotation thereof to be shifted axially of said valve body between plugged and unplugged positions, said valve plug including a second portion dimensioned to prevent it from escaping through said threaded bore in the absence of rotation of the plug to thereby secure said plug against accidental escape from said valve body, and said valve plug includes a third unthreaded portion intermediated said first and second portions, said third portion dimensioned so as to form a pathway between said third unthreaded portion and said internally threaded bore wherein gas can flow through said valve body when said valve plug is in an unplugged position.

23. A distortion reducing insulating glass unit comprising:

a pair of generally parallel panes separated peripherally by a spacer and defining a sealed between-pane space, one of said panes having an aperture therethrough;

a valve body extending through said aperture, the valve body having a stem, a cavity therein and opposed, open ends;

a washer assembly comprising a washer dimensioned to receive said stem therethrough; and an elongated valve plug received in said valve body and securably shiftable along its length between plugged and unplugged configurations, wherein gas can flow through a pathway between said valve body and said valve plug when said valve plus is in an unplugged position.

24. The glass unit of claim 23 wherein said cavity and valve plug include engaging threaded portions enabling said valve plug by rotation thereof to be shifted axially of said valve body between plugged and unplugged positions, said valve body and valve plug having engagable portions securing said plug against accidental escape from said body by axial, non-rotating movement of said plug.

25. The glass unit of claim 23 or claim 24 wherein said body includes a shoulder at one end sealingly engaging one side of the pane about its aperture and said washer further comprises an annular surface to engage the other side of the pane about its aperture to thereby sandwich the pane between said shoulder and said annular surface of said washer.

26. The glass unit of claim 25 wherein said washer is securely press-fitted to said stem of said valve body.

27. The glass unit of claim 23 wherein said cavity includes an internally threaded bore, and wherein said valve plug includes a first threaded portion threadingly engaging the internally threaded bore and enabling said valve plug by rotation thereof to be shifted axially of said valve body between plugged and unplugged positions, a second portion dimensioned to prevent said plug from escaping through said threaded bore in the absence of rotation of the plug to thereby secure said plug against accidental escape from said valve body, and a third portion intermediate said first and second portions and dimensioned so as to form a gas passageway between it and the internally threaded bore wherein gas flows through said passageway when said first threaded portion is unscrewed from said internally threaded bore.

28. A method of administering a pressure equalization valve to an insulating glass unit comprising the steps of:

providing an aperture in a first glass sheet, said first glass sheet comprising an inner surface exposed to a between-pane space of an insulating glass unit and an outer surface exposed to atmosphere;

inserting a valve body into said aperture in said first glass sheet, said valve body comprising a threaded opening, a stem, and a shoulder, said shoulder including an annular surface which faces and confronts said outer surface of said first glass sheet;

applying a washer over said stem until said washer is positioned against said inner surface of said first glass sheet and said stem is received therethrough;

threading a valve plug into said threaded opening of said valve body, said valve plug including a first and second threaded portion and an intermediate unthreaded portion therebetween; and assembling said first glass sheet, a second glass sheet and a spacer into said insulating glass unit.

29. The method of claim 28 wherein sealant is applied to the outer surface of said stem and onto the annular surface of said shoulder and the inner face of said washer to form a gas-tight seal.

30. The method of claim 29 wherein said sealant is polyisobutylene.

31. A method of equalizing the pressure inside an insulating glass unit and the exterior ambient atmosphere comprising the steps of:

positioning a pressure equalization valve on the insulating glass unit, said pressure equalization valve comprising (i) a valve body including a stem, an internal cavity and opposed open ends, (ii) a washer assembly including a washer having an inner face adapted to snugly position against a glass pane and an aperture sized to receive said stem therethrough and (iii) an elongated valve plug received in said internal cavity of said valve body and securably shiftable axially along its length between plugged and unplugged position;

rotating said valve plug until a first threaded portion is threadably disengaged from said internal cavity;

moving said valve plug axially away from said internal cavity until at least a portion of an intermediate unthreaded portion of said valve plug is disposed outside of said valve body; and permitting said gas to flow through said internal cavity of said valve body between a between-pane space of the insulated glass unit and an exterior gas source or ambient atmosphere until pressure in said between-pane space is equal to ambient pressure.

32. The method of claim 31 further comprising the steps of connecting the source of gas to said valve body so that it extends at least partially through said internal cavity and delivering gas to the between-pane space of said insulating glass unit.

33. The method of claim 31, wherein the gas source is argon.

* * * * *